US006020659A

United States Patent [19]

Crowther et al.

[11] Patent Number: 6,020,659

[45] Date of Patent: Feb. 1, 2000

[54] RAMPING ELECTRONIC SWITCH SYSTEM

[75] Inventors: Jonathan Crowther, Landenberg, Pa.; Earl T. Jackson, Newark, Del.

[73] Assignee: Primed Products Inc., Landenberg, Pa.

[21] Appl. No.: 08/593,397

[22] Filed: Jan. 29, 1996

[51] Int. Cl.[7] ..... H01H 3/34

[52] U.S. Cl. ..... 307/141.4; 315/DIG. 4; 315/313; 315/314; 315/362; 323/905; 323/212; 323/211

[58] Field of Search ..... 315/DIG. 4, 313, 315/314, 362; 323/905, 212, 217

[56] References Cited

U.S. PATENT DOCUMENTS

| | | | |
|---|---|---|---|
| 4,160,192 | 7/1979 | McAllise | 315/194 |
| 4,379,254 | 4/1983 | Hurban | 315/291 |
| 4,490,625 | 12/1984 | Dilly | 307/116 |
| 4,508,997 | 4/1985 | Woodnut | 315/360 |
| 4,939,428 | 7/1990 | DePauli | 315/291 |
| 4,963,793 | 10/1990 | DePauli | 315/74 |
| 5,319,283 | 6/1994 | Elwell | 315/194 |

*Primary Examiner*—William M. Shoop, Jr.
*Assistant Examiner*—Kim Lockett

[57] ABSTRACT

The present invention relates to an electronic switch system for controlling AC power to a load. The switch has ON, OFF and RAMP down modes that can be selected by means of momentary touch switches. When put into the RAMP down mode, the power to the load decreases slowly at a gradual continuous uninterrupted predetermined rate. This switch system has particular utility in brightness control of lamps. It has been found that the use of a lamp controlled by an electronic switch of the present invention often will induce sleep for people that have difficulty going to sleep, particularly young children and older persons. Thus the electronic switch system and devices embodying this system are particularly useful in a method to induce sleep.

5 Claims, 3 Drawing Sheets

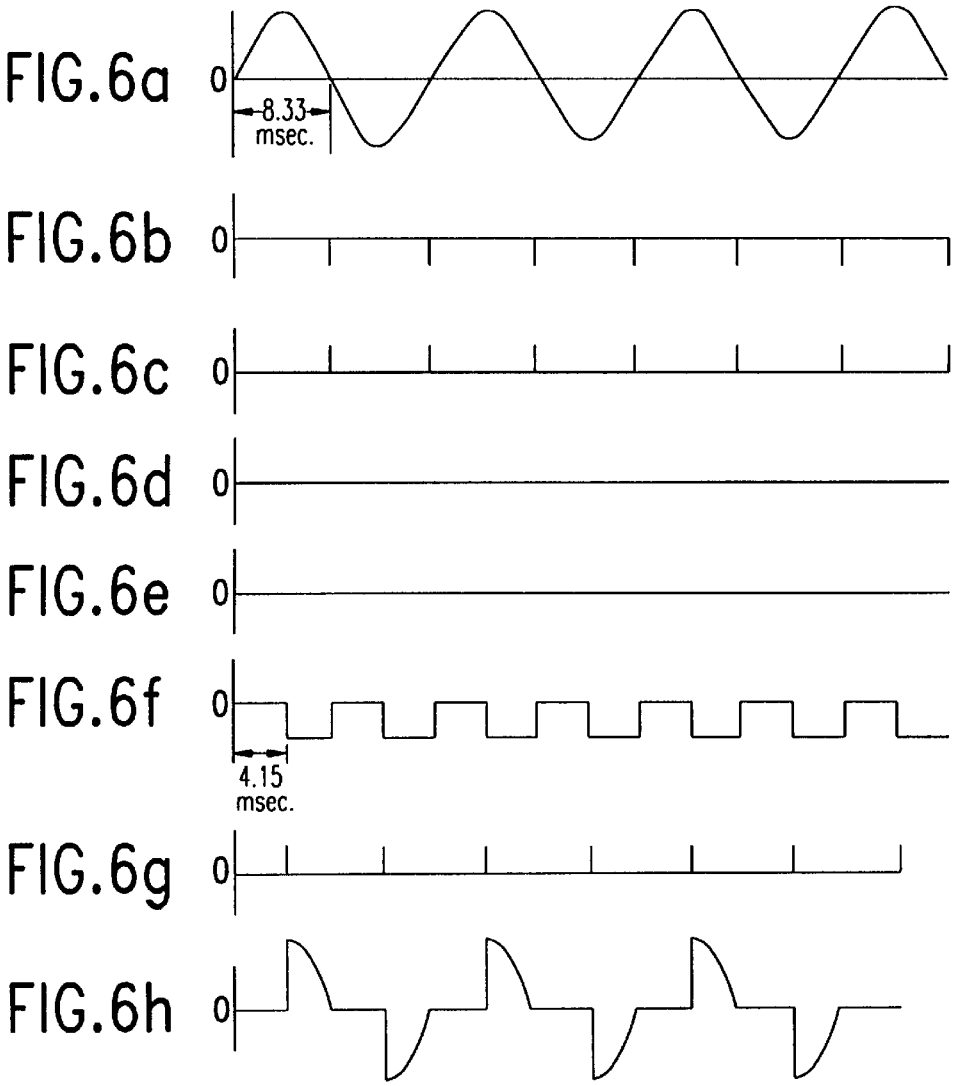
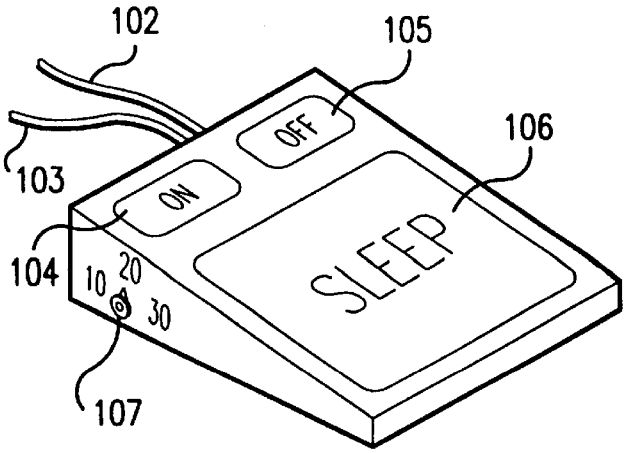
FIG.8

RAMPING ELECTRONIC SWITCH SYSTEM

BACKGROUND OF THE INVENTION

The present invention relates to an electronic switch system for delivering alternating current (AC) to a load having ON, OFF, and down RAMP modes, devices embodying this switch system, and use of such a device to induce sleep.

There are many switch systems and devices currently commercially available that have ON, OFF and intermediate power delivery modes, particularly for lamps. A number of light switch devices contain a mechanical timer that turns a lamp off and on at present times.

Also, the prior art describes electronic light switch systems. U.S. Pat. No. 4,939,428 describes an electronic lamp switch system comprising a touch membrane switch that can fix the lamp load at various levels depending on where the membrane is touched, followed by shut off of the lamp at a preselected later time.

These prior art mechanical and electronic switching devices to control lamps are not entirely satisfactory. The mechanical devices wear out in time. The device of U.S. Pat. No. 4,939,428 can be set at one of several intermediate light levels, but after the pre-set time the lamp is abruptly turned off, tending to interrupt sleep.

SUMMARY OF THE INVENTION

The present invention relates to an electronic switch system for controlling AC power to a load. The switch has ON, OFF and RAMP down modes that can be selected by means of momentary touch switches. When put into the RAMP down mode, the power to the load decreases slowly at a gradual continuous uninterrupted predetermined rate.

This switch system has particular utility in brightness control of lamps. It has been found that the use of a lamp controlled by an electronic switch of the present invention often will induce sleep for people that have difficulty going to sleep, particularly young children and older persons. Thus the electronic switch system and devices embodying this system are particularly useful in a method to induce sleep.

DEFINITIONS

The following terms, as used herein, have the indicated meanings:

"Ramp" (and RAMP) as used with respect to illumination, voltage, current and/or power is a verb meaning decrease slowly, gradually, continuously and uninterruptedly. "Ramp" is not limited to linear, or straight line, decrease, however, it is gradual, excluding decreases that have any abrupt rate changes, such as steps. Ramp is slow, not instantaneous, taking a minimum time from full on to off of at least about one minute. "Dim" as used herein with respect to a lamp means illumination ramp. "Continuously" as used with respect to ramping and/or dimming means that the decrease once started, remains at a positive decrease until the ultimate stopping point. The rate of decrease need not remain the same throughout the ramping and/or dimming. "Uninterrupted" as used with respect to ramping and/or dimming means that the decrease once started continues as a positive decrease until the ultimate stopping point, and there are no abrupt rate changes in the decrease throughout the ramping and/or dimming.

"Zero crossover voltage point" and "zero-crossover point" as used herein mean the point(s) in time, with respect to AC current, when the voltage is at zero in transition from positive to negative voltage and vice versa, twice during each full cycle.

"Mode" as used herein with respect to switches, circuits and the like has its conventional meaning of"manner of acting or doing". When used with respect to sleep, as in sleeping mode, "mode" means under conditions conducive to sleeping.

BRIEF DESCRIPTION OF THE INVENTION

The present invention is an electronic switch system for delivering AC power to a load. The system has off and on modes, and is characterized by having a ramping down mode during which the power delivered to the load slowly, gradually, continuously and uninterruptedly decreases to zero at a predetermined rate, said system comprising on, off and ramp switch means.

The system normally also comprises a load power circuit having therein a circuit switching means that has conducting and non-conducting modes. The circuit switching means is capable of being put into the conducting mode by receipt of a signal pulse and thereafter into the non-conducting mode when the AC power is at it's next zero crossover voltage point.

The preferred electronic switch means also has an OFF switch means that when activated discharges the storage capacitor more rapidly than the ramp switch means. The OFF switch means is a touch switch that discharges the storage capacitor rapidly so long as it is being touched to activate the touch switch. If held long enough, the power to the load goes all the way to OFF. However, if touched for a shorter time, the load power will only go partially OFF followed by ramping down to zero power. Thus, the OFF switch in this embodiment can be used (when the load is under power) to initially decrease the power to a preselected level followed by ramping to zero load power. In this preferred switching system, the ramp switching means is similarly capable of rendering the load power circuit under power at a preselected level before ramping the power.

The present invention also embodies devices embodying such electronic switch system.

Also the present invention embodies a method of inducing sleep in a person comprising placing the person in a sleep-inducing mode in a normally dark environment that is illuminated, and gradually and continuously diminishing the illumination at an uninterrupted predetermined rate to zero.

BRIEF DESCRIPTION OF THE DRAWING FIGURES

For a detailed description of the preferred embodiment of the electronic switch system of the present invention, reference is made to the drawings in which:

FIG. 6 is timing diagrams of the voltage at various points in the circuits of FIGS. 1–5.

FIG. 8 is a perspective view of a switch device embodying the electronic switch system, designed for use with a sleep lamp.

DETAILED DESCRIPTION OF THE PREFERRED EMBODIMENTS

Figure 1:
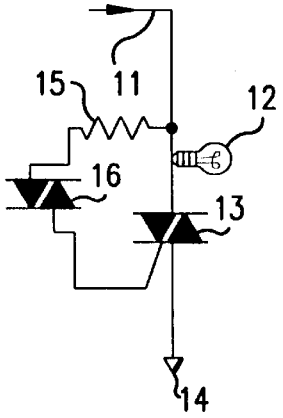
FIG. 1 is a schematic of the load power circuit.

The preferred embodiment of the present invention comprises:

A. A load power circuit comprising (1) means to receive AC power which means is capable of delivering AC power to a load; (2) load power circuit switching means in line with the means to receive AC power having conducting and non-conducting modes, which switching means is put into the conducting mode by receipt-of a signal pulse and thereafter into a non-conductive mode when the AC power is at a zero crossover voltage point; and (3) a pulse signal circuit capable of receiving a pulse signal and conducting it to the load power circuit switching means, whereby the load power circuit switching means is put into a conductive mode until the AC power is at a zero voltage crossover point.

B. A continuous constant DC voltage source.

C. A control logic system capable of sending the pulse signal to the load power circuit switching means. This system comprises (1) means to receive the continuous constant DC voltage power; (2) a pulse signal transmitter coupled to the pulse signal circuit in the load power circuit; (3) a pulse signal generator, the output of which is voltage pulses that are directed to the pulse signal transmitter, the pulses being generated at the start of a decrease in the voltage that is conducted to the pulse generator from a delay control signal generator; and (4) a delay control signal generator which receives (a) from a zero crossover point pulse generator, a crossover point pulse DC output that coincides with the zero voltage crossover points of the AC power, and (b) a variable continuous DC delay control voltage from a delay control voltage system. The delay control pulse generator generates a DC delay control pulse output that is conducted to the pulse signal generator. Each delay control pulse of this output starts upon receipt of each pulse from the zero crossover point detector means. The end of each delay control pulse is controlled by the variable continuous DC delay control voltage output from the delay control voltage system; a maximum variable continuous DC delay control voltage results in no substantial delay between the start and the end of each DC delay control pulse, and decreasing continuous DC delay control voltage results in increasing delay between the start and end of each DC delay control pulse.

D. A zero crossover point pulse generator that transmits to the delay control pulse generator a crossover point pulse DC output the pulse of which coincide with the zero voltage crossover points of the AC power. The zero crossover point pulse generator comprises (1) means to receive an AC power source synchronized in cycle timing with the AC power source in the load power circuit, and (2) a zero crossover point detector that generates the zero voltage crossover point pulse DC output.

E. A delay control voltage system which conveys a variable continuous DC delay control voltage to the control logic system. This system comprises (1) means to receive the continuous constant DC voltage; (2) means to transmit the continuous variable DC delay control voltage to the control logic system; (3) a storage capacitor on which the delay control voltage is generated, which capacitor is capable of delivering the delay control voltage to the means to transmit; (4) a controlled discharge means capable of discharging the voltage on the storage capacitor at a predetermined rate when a ramp switching means is activated; (5) means to prevent discharge of the storage capacitor through the means to transmit; (6) flip-flop switch means having a constant voltage DC output mode and a zero voltage output mode, which flip-flop switch means is connected to (a) switching means that when activated sets and maintains the flip-flop switching means in a constant voltage DC output mode whereby the storage capacitor is charged, and (b) switching means that when activated sets and maintains the flip-flop switch means in a zero voltage output mode enabling the storage capacitor to discharge; (7) a ON switch means that when activated sets and maintains the flip-flop switch means in the constant voltage DC output mode; and a RAMP switch means that when activated sets and maintains the flip-flop switch means in the zero voltage output mode, charges the storage capacitor and causes the controlled discharge means to discharge the voltage on the storage capacitor at a gradual uninterrupted continuous predetermined rate.

Referring to FIG. 1, the preferred load power circuit of the present invention electronic switch system comprises input power line 11 means to receive AC line power, normally 115V from an AC line power source such as a wall receptacle into which the switch system device is plugged. Power line 11 delivers AC power to the load, shown here as load lamp 12, through load power circuit switch means in power line 11 shown here as a triac 13; and then to ground 14. Triac 13 is in a non-conductive mode until it receives a voltage pulse signal from the load pulse signal circuit made up of 15000 ohm resistor 15 and an optical coupler receiving unit 16.

Figure 4:
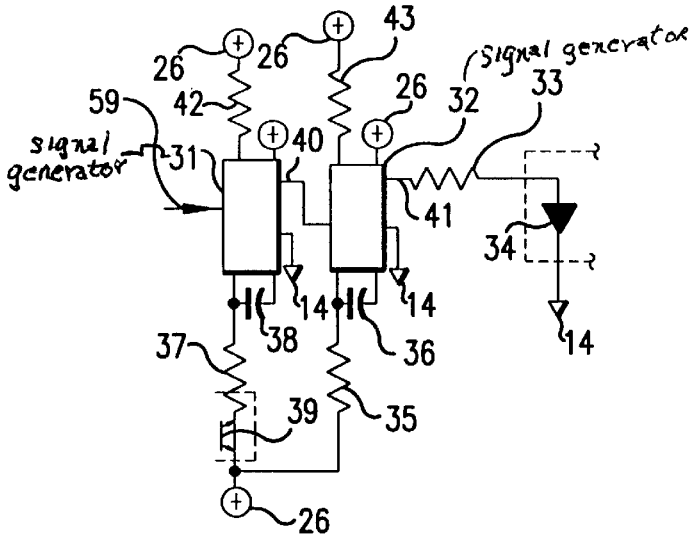
FIG. 4 is a schematic of the control logic system circuit.

When receiving unit 16 receives a pulse signal (from the optical coupler pulse signal transmitter unit 34 in FIG. 4), the pulse puts triac 13 into the conducting mode closing the load circuit power line through load lamp 12, until triac 13 is put in the non-conductive mode when the AC power is at it's next zero voltage crossover point.

If, however, triac 13 receives pulses simultaneously with each of the AC power zero crossover voltage points, triac 13 remains conductive and full power is continuously supplied to load lamp 12. Conversely, if triac 13 is not receiving any pulses, triac 13 is non-conductive and no power is supplied to load light 12.

When the electronic switch system is in the ramp mode, each pulse of the pulse signal is delayed until after the AC power source zero voltage crossover point. This renders triac 13 non-conductive for the time between the zero crossover voltage point and receipt of a delayed pulse from the pulse signal, resulting in less than full power being delivered to load lamp 12. In the ramp mode, the delay time slowly, gradually, continuously and uninterruptedly increases; the power delivered to the load light ramps slowly, gradually, continuously and uninterruptedly, and the load light 12 slowly, gradually, continuously and uninterruptedly dims to zero power.

Figure 2:
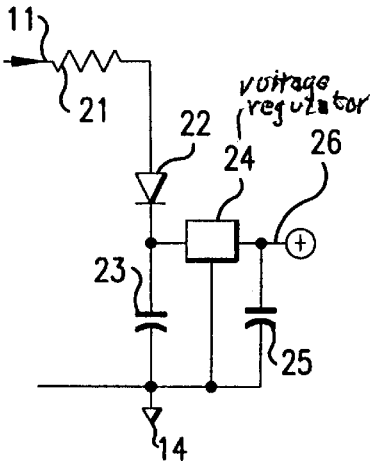
FIG. 2 is a schematic of the continuous constant direct current (DC) voltage power source circuit.
Figure 5:
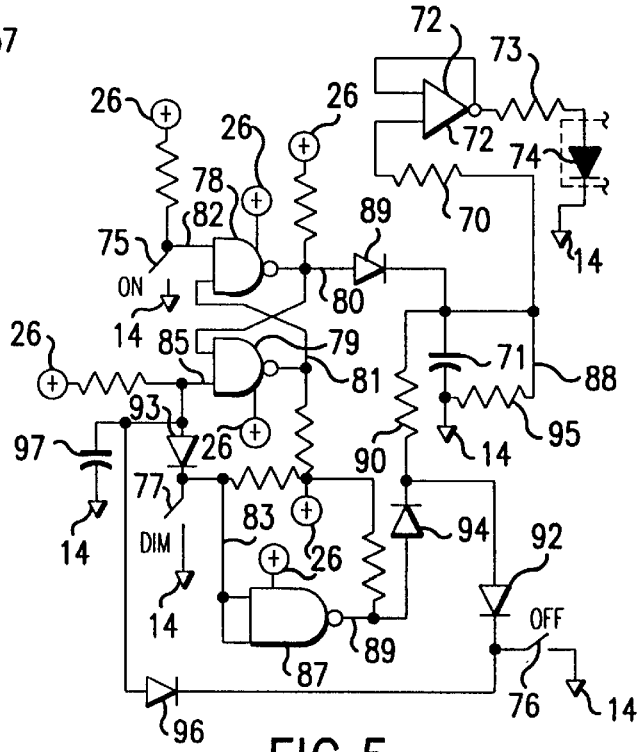
FIG. 5 is a schematic of the delay control voltage system circuit.

Referring to FIG. 2, the preferred continuous constant DC voltage source is supplied by the rectifying circuit connected between the power line and ground. The rectifier circuit comprises power line 11; 5000 ohm 5W resistor 21; power diode (1N4002) half wave rectifier 22; 1000 MFd capacitor 23 running from power line 11 to ground 14; 5 volt constant DC voltage regulator 24 connected between the output of rectifier 22 and ground 14; and 10 MFd stabilizer capacitor 25 connected between the output of 5 volt regulator 24 and ground 14. The output 26, denoted + in the Figures, is continuous constant positive 5 volts DC that is delivered to the control logic system (FIG. 4), the zero crossover point pulse generator (FIG. 3) and the delay control voltage system (FIG. 5).

Figure 3:
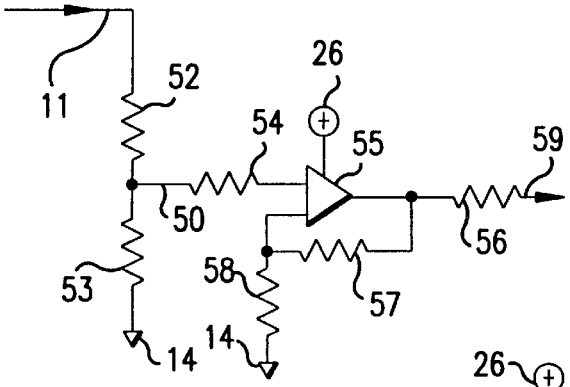
FIG. 3 is a schematic of the zero crossover point pulse generator circuit.

Referring to FIG. 3, the electronic switch system comprises a zero crossover point pulse generator circuit that delivers a negative DC pulse signal to delay control pulse transmitter one-shot 31 (FIG. 4). Each pulse of this signal occurs at each zero voltage crossover point in the AC input power line 11 to the load 12 (FIG. 1). It is important that the zero voltage crossover point pulses coincide in time precisely with the zero crossover voltage points in the AC input power line 12.

In the preferred embodiment shown in FIG. 3, the preferred zero crossover point pulse generator circuit comprises an AC power source synchronized in cycle timing with the AC input power line 11 (FIG. 1). In the preferred embodiment of the present invention the same AC input power source is used to supply the zero crossover point pulse generator and the load power circuit, normally a 115 volt wall outlet, being received at input power line 11. Between line 11 and ground 14 are voltage splitting resistors 52 (36,000 ohms) and 53 (2700 ohms). Line 50 is supplied with 8.6V 60 cycle AC synchronized in cycle time with the AC input power line to load lamp 12. This voltage is delivered through 1000 ohm resistor 54 to zero voltage crossover detector 55. Detector 55 also receives continuous constant DC voltage via line 26 from the DC power source shown in FIG. 2. The zero crossover point negative DC pulse signal from zero crossover detector 55 is transmitted through 330 ohm resistor 56 via output line 59 to the delay signal generator one-shot 31 (FIG. 4). Voltage divider resistors 57 (100K ohms) and 59 (1K ohm) in conjunction with resistor 56 insures the proper level of the pulse signal from detector 55.

FIG. 4 shows the preferred control logic system. This system receives, from the delay control voltage system (FIG. 5), the electronic switch system operator's commands as to the mode of the load power, whether ON, OFF or RAMP. The output of the control logic system is a positive DC pulse signal that triggers the start of power to the load.

The load power is activated for the period of time between a pulse signal transmitted from the control logic system (which activates the flow of AC load current through triac 13) and the next zero voltage crossover point of the load AC (which deactivates the flow of AC load current through triac 13). If a pulse signal is transmitted from the control logic system that coincides with each AC zero voltage crossover point, triac 13 remains in the conductive mode and full power is continuously supplied to the load lamp 12 (the ON mode). If no pulse signals are transmitted, triac 13 remains non-conductive (the OFF mode). If, however, pulse signals are transmitted (120 per second, each AC half cycle) but each pulse signal is delayed until after the time of the AC zero crossover voltage point, power is not delivered to the load during the part of the AC half cycles preceding each pulse signal. The function of the control logic system is to transmit the appropriate pulse signal output called for by the operator's commands, which is reflected to the control logic system by a continuous variable DC delay control voltage output sent by the delay control voltage system, hereinafter described.

The preferred control logic system shown in FIG. 4 comprises means to receive continuous constant DC voltage 26 (FIG. 2); two retriggerable monostable multivibrators (one-shots) MC14528, delay control signal generator one shot 31 hooked in series with pulse signal generator one shot 32. The pulse signal output 41 of one-shot 32 goes through current limiter 330 ohm resistor 33 to the optical coupler transmitting unit 34 (which is coupled to the optical coupler receiving unit 16, FIG. 1) and on to ground 14. Resistors 42 and 43 are 6.2K ohm pull-up resistors.

The continuous constant DC voltage output 26 is connected through 15000 ohm timing resistor 35 to delay control signal generator one-shot 32. Capacitor 36 (0.01 MFd) is connected between the output of resistor 35 and of one-shot 32. The continuous constant voltage output 26 is also connected through optical coupler receiving unit 39 in series with 1500 ohm timing resistor 37 to delay control signal generator one-shot 31. Timing capacitor 38 (0.24 MFd) is connected between the output of resistor 37 and one-shot 31. This R/C resistor 37/capacitor 38 circuit determines the delay in the ending of the pulses from the delay control signal generator one-shot 31.

Optical coupler receiving unit 39 is rendered conductive by the output of optical coupler transmitter unit 74 of the delay control voltage circuit (FIG. 5), transmitting continuous DC current to one-shot 31. The magnitude of this DC current to one-shot 31 is directly proportional to the magnitude of the delay control voltage output of the delay control voltage circuit.

Also, the output 59 of the zero crossover point pulse generator circuit (FIG. 3) is received at the negative input of one-shot 31. The output 59 is 120 pulses/sec positive DC voltage pulses that coincide with the crossover points of the AC source line power.

The output 40 of the delay control signal generator one shot 31 is a delay signal consisting of positive voltage pulses, which are transmitted to the negative input of signal pulse generator one shot 32. The start of each delay control signal pulse from the delay signal generator one-shot 31 occurs upon receipt of a pulse from the zero voltage crossover point detector circuit (FIG. 3). The termination of each delay pulse is controlled by the variable continuous DC delay control voltage output of the delay control voltage system. The maximum delay control voltage results in no substantial delay between the start and end of each DC delay control signal pulse. This gives an instantaneous short pulse output from delay signal generator one-shot 31, which coincides in time with each pulse of the output from the zero crossover point pulse generator circuit.

The delay signal pulses from the delay signal generator have a leading edge substantially instantaneous voltage increase, followed by a variable substantially constant voltage delay segment, and then a trailing edge substantially instantaneous voltage decrease to zero. Signal pulse generator one-shot 32 transmits an instantaneous signal pulse to activate triac 13 whenever there is a voltage decrease in the delay pulse output of delay pulse generator one-shot 31.

Thus, if the delay signal pulse from one-shot 31 has no constant voltage delay segment, the trailing edge voltage decrease instantaneously follows the leading edge start of the delay signal pulse. This causes 120/sec pulse signals to be transmitted from one-shot 32 coinciding with each AC zero voltage crossover point, maintaining triac 13 conductive and full power to the load lamp 12. This condition prevails when maximum variable continuous DC voltage is transmitted to optical coupler receiving unit 39 from the delay control voltage system. As the variable continuous DC voltage from the delay control voltage system decreases, the delay segments of the delay signal pulses increase, thereby delaying activation of load power until after a part of the AC half wave. Each half wave lasts 1/120th of a second, or 8.33 msec. As the variable continuous DC control voltage decreases, the delay segment of each delay signal pulse increases in time. When the continuous DC control voltage approaches zero, the delay segments increase in time to more than 8.33 msec delay. Under these circumstances, the output from the zero crossover point pulse generator retriggers a voltage increase leading edge of a delay signal pulse before the previous delay signal pulse has had a trailing edge voltage decrease. In the absence of any trailing edge voltage decreases from delay signal generator one-shot 31, no pulse signals are generated by one-shot 32, triac 16 is not rendered conductive, and no power is delivered to the load—the OFF mode.

As aforementioned, the extent of the delay is controlled by the magnitude of the current received by one-shot 31 through optical transmitter receiver unit 39, which is directly proportional to the voltage output of the delay control voltage system. This current is impacted on capacitor 38, which controls the duration of the delay in each delay pulse output of one-shot 31, by creating an impedience system that varies with the delay control voltage system output.

In the preferred circuit shown in FIG. 4, maximum delay control voltage on capacitor 38 is 4.2 volts DC, which keeps load light 12 fully on. If there is only 2 volts or less delay control voltage, the delay segments in the delay pulses from delay control generator one-shot 31 are over 8.33 msec., which keeps load light 12 off Intermediate delay control voltages cause intermediate illumination of load light 12. The 15K ohm resistor 35 and the 0.1 MFd capacitor 36 insure a uniform fixed pulse signal from one-shot 32.

Referring to FIG. 5, the delay control voltage system receives the external operator's commands to the electronic switch system and translates them into delay control voltage. This delay control voltage 88 determines the output of the control logic system thereby dictating the level of power being delivered to the load, whether full on, off, or ramping down, as hereinbefore described.

The focal point of the delay control voltage system is the storage capacitor 71. The voltage on storage capacitor 71 is transmitted via line 88 through 10 Kohm resistor 70, voltage follower 72 and 330 ohm resistor 73 to optical coupler transmitting unit 74. When current passes through this transmitting unit 74, it optically puts optical coupler receiving unit 39 in the control logic system (FIG. 4) into a conducting mode. The higher the voltage on storage capacitor 71, the higher the voltage output of voltage follower 72 and the greater the current passing through coupler transmitting unit 74. The greater this current, the greater the delay control current transmitted to delay pulse transmitter one-shot 31 and the shorter the delay segment of the delay signal pulse from one-shot 31. Thus the voltage on storage capacitor 71 controls the power delivered to load light 12.

External commands are delivered to the electronic switch system through ON switch 75, OFF switch 76 and DIM down ramp switch 77 (frequently denoted SLEEP in lamp control devices).

NAND Gates 78 and 79 are hooked up to form a flip-flop circuit. Voltage inverter 87 (here a NAND Gate with a single input), delivers a zero voltage in output line 89 if the input line 83 is at a positive voltage, and vice versa. These three NAND Gates are on a single SN7400 chip; the fourth NAND Gate in the chip is not used.

Referring to FIG. 6, timing diagrams 6a to 6h show the voltage at various points in the circuits of FIGS. 1–5. Diagram 6a is the AC input line 11, which supplies the load power circuit, the continuous constant DC voltage circuit, and the zero crossover point pulse generator circuit. The voltage as depicted is 60 cycle AC, having a half wave time of 8.33 msec. The zero crossover points are the two times per cycle when the voltage is zero as the current goes from positive to negative and vice versa. The area under the curve represents the power.

Diagram 6*b* is the output from the zero crossover point detector 55, negative DC pulses 120/sec coinciding in time with the zero voltage crossover points of input line 11, diagram 6*a*.

Diagram 6*c* represents the output 40 of the delay control signal generator one-shot 31 when maximum variable continuous DC voltage is transmitted from the delay control voltage system. There are no constant voltage flat delay segments in the pulsed output, and the trailing edge voltage decrease instantaneously after the leading edge of the delay signal pulse. Pulse signals 120/sec are being transmitted from one-shot 31 to signal pulse generator one-shot 32, which is transmitting to triac 13 a 120/sec instantaneous pulse output coinciding with each AC zero voltage crossover point, maintaining triac 13 conductive and load lamp 12 on at full power.

Diagram 6*d* shows the output 40 of delay signal generator one-shot 31 at maximum delay, when the delay control system is generating little or no variable continuous DC voltage. The delay is greater than 8.33 msec and so the output from the zero crossover point pulse circuit retriggers the delay signal generator one-shot 31 before there is any trailing edge in its output 40. As shown in diagram 6*e,* no signal pulses are generated in the output 41 of the signal pulse generator one-shot 32, therefore load lamp 12 is off.

Diagrams 6*f*, 6*g* and 6*h* represent the half load power timing diagrams of the outputs of delay signal generator one-shot 31 (6*f*), pulse signal generator one-shot 32 (6*g*), and triac 13. The delay between the leading and trailing edges of the delay signal pulses are 4.16 msec., ½ of each AC power half-wave (6*a*).

Switches 75, 76 and 77 are instantaneous membrane touch switches, similar to the switch described in U.S. Pat. No. 4,939,428 but having only a single switching contact point in each switch. A light touch will put the switch in the contact (closure) mode momentarily until the touch is discontinued. This type switch is the preferred touch switch means.

In operation, when the electronic switch system with a load light 12 in place is energized (plugged into a 115 volt AC wall outlet), 5 volts continuous DC is delivered to the DC lines 26. Flip-flop NAND Gate 78 receives positive DC voltage through input line 82, which induces zero volts in output line 80. This zero volts is reflected through blocking diode 1N914 89 and 1000 ohm timing resistor 90 to storage capacitor 71 (as zero delay control voltage.) Storage capacitor 71 reflects this zero delay control voltage to the control logic system (FIG. 4), which maintains load lamp 12 in a zero power (off) mode. Signal diodes 92–93 and 94 are also 1N914.

Capacitor 97 in input line 85 to NAND Gate 79 delays the setting of NAND Gate 79 until after NAND Gate 78 has already set the output 81 of NAND Gate 79 at positive voltage. This assures that NAND Gate 78 is in control when the system is initially energized and so the load lamp 12 is off.

When ON touch switch means 75 is touched, input line 82 to NAND Gate 78 is grounded to zero volts. This sets the output of NAND Gate 78 at positive volts, which is transmitted to storage capacitor 71 and to the control logic system, resulting in full power to load lamp 12. NAND Gate 78 remains set in this positive voltage output mode to storage capacitor 71 until it is reset.

When, after ON switch 77 has caused load lamp 12 to be lighted, it is desired to turn the lamp off, OFF touch switch 76 is touched. This grounds storage capacitor 71, through line 91, diode 92 and OFF switch 76, thereby rapidly decreasing the delay voltage to the control logic system which delays power to the load lamp 12. If switch 76 is contacted long enough, about one second in the illustrated circuit, the lamp goes completely off. Shorter contacting partially decreases the load lamp 12 power to a preselected level, followed by ramping down to completely off. This time period required for touching OFF switch 76 from full to zero power can be varied by the resistance in the OFF circuit. Thus the OFF switch 76 can be used to activate ramping when the load lamp 12 is in the on mode.

When it is desired to turn the load lamp to the DIM ramping (SLEEP) mode, DIM touch switch 77 is touched. This grounds flip-flop NAND Gate 79 input line 85 to zero volts, through diode 93 and DIM switch 77. The zero voltage in input line 85 results in a positive voltage in NAND Gate 79 output line 81, and resets to zero voltage NAND Gate 78 output line 80. Touching DIM switch 77 also puts input line 83 to voltage inverter 87 at zero volts, so the output from inverter 87 is positive voltage in output line 89. This positive voltage is transmitted through diode 94 and resistor 90, increasing the voltage charge to storage capacitor 71. When DIM switch 77 is released, this voltage on storage capacitor 71 is discharged to ground through ramping resistor 95.

As aforementioned, when DIM switch 77 is touched it increases the voltage charge to storage capacitor 71 (unless already at full voltage). This increase goes to a full-on 4.2 volts on storage capacitor 71 over a period of time, about 1 second if DIM switch 77 is contacted for this length of time. Contact for less time delivers less voltage to storage capacitor 71. This enables the operator to put load lamp 12 under a preselected level of power by one or more short touches to DIM switch 77. This is a particularly useful fixture when the lamp 12 is off, and it is desired to turn it on only partially followed by ramping to zero.

Ramping resistor 95 is selected in size to discharge storage capacitor 71 slowly, gradually, continuously without interruption to zero voltage, and so dims load lamp 12 at a pre-selected rate, to off. In FIG. 5, ramping resistor 95 is 1 mega ohms; this discharges 470 MFd storage capacitor 71 from a full-on charge of 4.2 volts to substantially zero volts (load lamp 12 off) in 7½ minutes. The rate of discharge, and so the dimming rate, is preselected by the size of ramping resistor 95. If desired several ramping resistors 95 can be included, with a switch to select the desired dimming rate, giving full ramping times, for example, of 10, 20 and 30 minutes.

Figure 7:
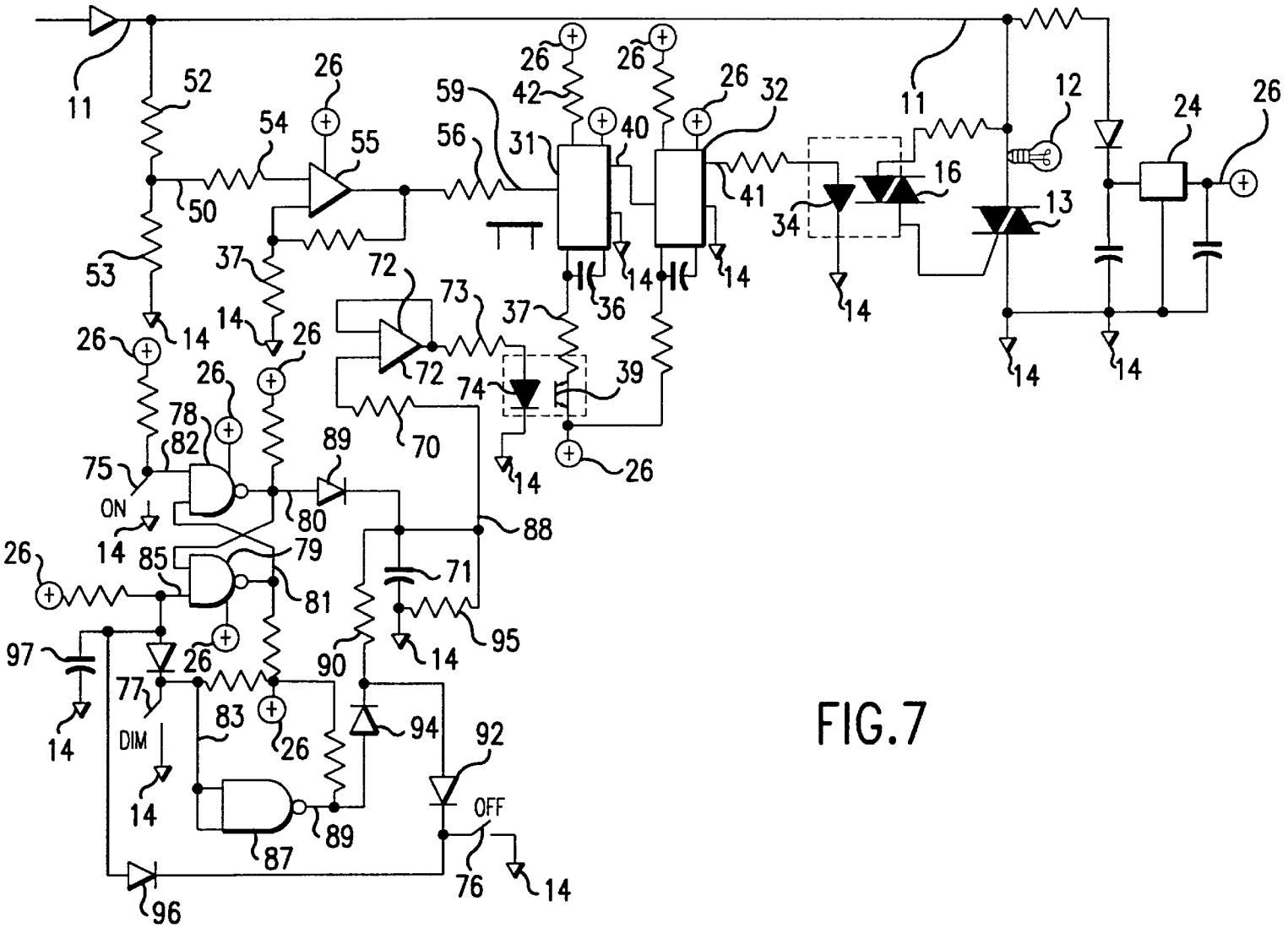
FIG. 7 is a schematic of the entire preferred electronic switch system of the present invention, hooking together the circuits of FIGS. 1–5.

FIG. 7 is a full schematic of this preferred electronic switch, showing how the circuits of FIGS. 1–5 are connected. This embodiment is suitable for use with a load lamp of up to 400 watts. Since no batteries or mechanical moving parts are required, the entire circuit can be put into a small encased unit as shown in FIG. 8. The numerals in FIGS. 6 correspond to the numerals in FIGS. 1–5.

FIG. 8 shows the control box containing a switching device of the present invention for use with a sleep lamp. It is plastic, approximately 6 inches long, 3 inches wide and 1½" thick at the cord end. Lines 102 and 103 preferably are a single insulated electric cord terminating in a socket having a male and a female terminal. The male terminal goes to a 115 AC wall receptacle and is connected to AC input line 103. The female terminal receives the male plug from the load lamp and is connected to line 102, the load power output to the lamp from the electronic switch device. Numerals 105, 106 and 107 are, respectively the ON, OFF and SLEEP (RAMP) membrane instantaneous touch switches that remain activated only while being touched. These switches are customarily referred to as touch "pads". Numeral 108 is a dimming time selector switch for setting the dimming off the lamp from full-on in 10, 20 or 30 minutes. The electronic switch system in this device has three separate ramping resistors selected to give these dimming times.

In this preferred sleep lamp embodiment, the SLEEP pad is illuminated, as a night light, and is always on when line 103 is plugged into an activated wall outlet. Being illuminated, the sleeper can readily find and touch the SLEEP pad, turning on the light. A long touch will bring the light to full power; shorter touches, to less power. Thereafter, dimming commences until the lamp goes off.

In using the electronic switch of the present invention to induce sleep, it is incorporated into a night lamp control device such as that shown in FIG. 8. The subject for the induced sleep is put in a sleeping mode in a normally darkened area, such as a bedroom with the window blinds closed. The night lamp switch is turned on and the lamp is connected to the control device, which is plugged into the wall receptacle AC power source. When it is time to induce sleep, the desired dimming time is selected and the SLEEP pad is touched long enough to light the lamp to the desired intensity. The lamp then immediately commences slowly dimming gradually, continuously and uninterruptedly to off at the rate pre-determined by the time selection and the time of touching the SLEEP pad. This combination of uninterrupted dimming (not jerky or step-wise) with selection of the ideal dimming time for the particular individual maximizes the comfort level of the individual and the effectiveness of this method in inducing sleep.

Another advantage of the present invention switching means is that it delivers power to the lamp during each half-wave of the AC input, thereby minimizing light flickering when nearing off. This is a problem encountered when only half-wave power is delivered to the lamp.

As can be seen from FIG. 8, the device is compact and light weight. No batteries are required. The pad touch switches are easy to operate even by young children. It has been found to be particularly effective for inducing sleep in children from 2 to 9 year in age, being an excellent sleep training method.

In addition to using with lamps, the electronic switch system can be used for many other applications where it is desired to smoothly clamp down power to a load at a pre-selected time. It can be used to control other electronic devices, to dim off music playing means, and to dim off many kinds of motors, particularly in industrial applications such as stirring, rotating or agitating. It has the advantage of being capable of delivering over 90%, up to 98%, of the input AC power to the load (when full-on).

It should be noted that the electronic switching means hereinbefore described need not comprise a load power circuit. This may be part of the unit being controlled by the electronic switch system of the present invention. Also the OFF and RAMP switches may be combined into a single switch that controls both the off and ramp modes.

Although the description above contains many embodiments, these should not be construed as limiting the scope of this invention but merely a providing illustrations of some of the presently preferred embodiments. Numerous other electronic elements are capable of performing the function of the illustrated elements, without departing from the concepts of the present invention. Thus, the scope of this invention should be determined by the appended claims and their legal equivalents rather than by the examples given.

We claim:

1. An electronic switch system for delivering AC power to a load, said system having off and on modes, characterized by having an electronic ramping down mode during which said power to said load gradually and continuously decreases to zero at a preselected rate, said system having on, off and ramp switching means comprising:

A. a load power circuit comprising:

(1) means to receive AC power which means is capable of delivering AC power to a load, (2) load power circuit switching means in line with said means to receive having conducting and non-conducting modes, which switching means is put into the conducting mode by receipt of a signal pulse and thereafter into the non-conducting mode when said AC power is at zero crossover voltage point, and (3) a pulse signal circuit capable of receiving said pulse signal and conducting said pulse signal to said load power circuit switching means, B. a continuous constant DC voltage power source;

C. a control logic system capable of sending said pulse signal to said load power circuit switching means comprising:

(1) means to receive said continuous constant DC voltage power, (2) a pulse signal transmitter coupled to said pulse signal circuit, (3) a pulse signal generator, the output of which is voltage pulses that are directed to said pulse signal transmitter, said pulses being generated at the start of a decrease in the voltage that is conducted to said pulse generator from a delay control signal generator, and (4) a delay control signal generator which receives (a) from a zero crossover point pulse generator, a crossover point output pulse that coincides with the zero voltage crossover points of said AC power, and (b) a variable continuous DC delay control voltage from a delay control voltage system, which delay control pulse generator generates a DC delay control voltage output that is conducted to said pulse signal generator, each delay control voltage segment of which output starts upon receipt of each pulse from said zero crossover point detector means and the end of each delay control pulse being controlled by said variable continuous DC delay control voltage output from said delay control voltage system, with a maximum variable continuous DC delay control voltage resulting in no substantial delay between the start and the end of each DC delay control pulse, and decreasing continuous DC delay control voltage resulting in increasing delay between the start and end of each DC delay control pulse.

D. a zero crossover point pulse generator that transmits a crossover point pulse DC output to said delay control pulse generator, the pulses of which output coincide with the zero crossover voltage points of said AC power source, comprising:

(1) means to receive an AC power source synchronized in cycle timing with said AC power source in said load power circuit, and (2) a zero crossover point detector that generates said zero voltage crossover point pulse DC output, and E. a delay control voltage system which conveys a variable continuous DC delay control voltage to said control logic system comprising:

(1) means to receive said continuous constant DC voltage, (2) means to transmit a continuous variable DC delay control voltage to said control logic system, (3) a storage capacitor on which said continuous variable DC delay control voltage is generated, which capacitor is capable of delivering said continuous variable DC delay control voltage to said means to transmit, (4) a controlled discharge means capable of discharging the voltage on said storage capacitor at a predetermined rate when a ramp switching means in activated, (5) means to prevent discharge of said storage capacitor through said means to transmit, (6) a flip-flop switch means having a constant voltage DC output mode and a zero voltage output mode, which flip-flop switch means is connected to (a) switching means that when activated sets and maintains said flip-flop switching means in a constant voltage DC output mode whereby said storage capacitor is charged, and (b) switching means that when activated sets and maintains said flip-flop switch means in a zero voltage output mode enabling said storage capacitor to discharge;

(7) a ON switch means that when activated sets and maintains said flip-flop switch means in said constant voltage DC output mode, and (8) a DIM switch means that when activated, sets and maintains said flip-flop switch means in said zero voltage output mode, charges said storage capacitor and causes said controlled discharge means to discharge the voltage on said storage capacitor at a gradual uninterrupted continuous predetermined rate thereby ramping said power to the load.

2. The electronic switch system of claim 1 in a device capable of delivering AC power to a load selected from the group consisting of lighting means, music playing means, electronic devices and motors.

3. The electronic switch system of claim 1 wherein during ramping said DIM switch means is capable of rendering said load power circuit under a desired increased power level followed by ramping said load power.

4. The electronic switch system of claim 1 comprising an OFF switch means which during ramping is capable of rendering said load power circuit under a desired decreased power level followed by ramping said load power.

5. The electronic switch system of claim 1 comprising an OFF switch means that when activated discharges said storage capacitor more rapidly than said DIM switch means thereby rendering said load power circuit under zero power or at a desired decreased level followed by ramping of said load power.

* * * * *